US008297988B2

(12) United States Patent
Sugiura et al.

(10) Patent No.: US 8,297,988 B2
(45) Date of Patent: Oct. 30, 2012

(54) PLATE-LIKE TERMINALS MOUNTING STRUCTURE

(75) Inventors: Tomohiro Sugiura, Shizuoka (JP); Hiroki Shiraiwa, Shizuoka (JP); Kazuomi Kiyosue, Shizuoka (JP); Akinori Nakashima, Shizuoka (JP); Noriyoshi Yamazaki, Shizuoka (JP); Minoru Umezaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 1 day.

(21) Appl. No.: 12/735,197

(22) PCT Filed: Dec. 12, 2008

(86) PCT No.: PCT/JP2008/072659

§ 371 (c)(1),
(2), (4) Date: Aug. 30, 2010

(87) PCT Pub. No.: WO2009/081768

PCT Pub. Date: Jul. 2, 2009

(65) Prior Publication Data

US 2010/0317241 A1 Dec. 16, 2010

(30) Foreign Application Priority Data

Dec. 21, 2007 (JP) ..... 2007-329990

(51) Int. Cl.
*H01R 12/00* (2006.01)

(52) U.S. Cl. ..... 439/76.2; 439/79

(58) Field of Classification Search ..... 439/76.2, 439/79

See application file for complete search history.

(56) References Cited

U.S. PATENT DOCUMENTS 7,497,698 B2 * 3/2009 Fujimaki ..... 439/76.2
7,566,230 B2 * 7/2009 Ozawa et al. ..... 439/76.2
2005/0233619 A1 * 10/2005 Takeuchi et al. ..... 439/76.2

(Continued)

FOREIGN PATENT DOCUMENTS

JP 01-142169 9/1989

(Continued)

OTHER PUBLICATIONS

International Search Report dated Mar. 3, 2009, issued on PCT/JP2008/072659.

(Continued)

*Primary Examiner* — Hien Vu
(74) *Attorney, Agent, or Firm* — Edwards Wildman Palmer LLP

(57) ABSTRACT

A plate-like terminal mounting structure is configured to attach a plurality of plate-like terminals in multiple tiers to a terminal holder for facilitated and effective positioning of the terminals in the terminal holder and prevention of undesirable impacts of the terminals upon a connection between the terminals and a circuit board. The terminal holder includes a plurality of ribs tapering toward their tips and parallel to each other. The terminal includes a recessed portions or holes for engaging the plate-like terminals with the ribs in a regular mounting position without gap left therebetween. The rib includes sloping surfaces on its four sides (front, rear, right, and left sides). The terminal holder includes a partition wall separating the terminals from each other, the partition wall being in one piece with the ribs. The plate-like terminals are arranged in multiple tiers in a height direction of the ribs. The recessed portion or the hole of the terminal in a lower tier is large, and the recessed portion or the hole of the terminal in the upper tier is small depending on tapering of the ribs.

4 Claims, 6 Drawing Sheets

U.S. PATENT DOCUMENTS

| | | | | |
|---|---|---|---|---|
| 2006/0292904 | A1* | 12/2006 | Kanou | 439/76.2 |
| 2009/0035964 | A1* | 2/2009 | Yamamoto et al. | 439/79 |

FOREIGN PATENT DOCUMENTS

| | | | |
|---|---|---|---|
| JP | 1-142169 | | 9/1989 |
| JP | 10-145941 | A | 5/1998 |
| JP | 2001-008332 | A | 1/2001 |
| JP | 2006-333583 | A | 12/2006 |

OTHER PUBLICATIONS

Notification of Reason for Refusal issued Jun. 26, 2012 for corresponding Japanese Application No. 2007-329990 with English translation.

* cited by examiner

PLATE-LIKE TERMINALS MOUNTING STRUCTURE

TECHNICAL FIELD

The present invention relates to a mounting structure of a plurality of plate-like terminals that allows connection of the plate-like terminals to a terminal holder with accurate positioning of the terminals, the plate-like terminals used to connect, for example, a fuse to a circuit board.

BACKGROUND ART

FIG. 11 illustrates an example of a junction block having conventional plate-like terminals (see the patent literature PTL 1).

The plate-like terminals 76 are made by a conductive metal plate bent substantially in an L-shape by punching, and are arranged in multiple tiers (stages) in a terminal holder 78 (block body) made of insulating resin. The terminal holder 78 includes fuse accommodating chambers 77*a* in upper and lower tiers in a first half of the terminal holder 78, the chambers 77*a* serving as a fuse holder, and in its second half a terminal insertion hole. A diapason-like clamping terminal portion on one end of the plate-like terminal 76 protrudes from the terminal insertion hole toward the fuse accommodating chamber 77*a*, and a pin-like terminal portion on the other end of the plate-like terminal 76 is inserted into a hole (throughhole) of a circuit board 73 and is solder-connected thereto. A fuse block 77 is constituted by the terminal holder 78, the plate-like terminals 76, and the fuse.

A junction block 71 includes, in addition to the fuse block 77, the circuit board 73 incorporating various electronic components 72 and a connector block 75 connected to terminals 74 on the right and left sides of the circuit board 73. The circuit board 73 and the blocks 75, 77 are covered and protected by upper and lower covers (not-shown) with the side of the openings 75*a*, 77*a* of the blocks 75, 77 exposed to an outside.

As the plate-like terminals, in addition to the substantially L-shaped terminals 76, a comb-like terminal having clamping terminals parallel to each other is used (not shown). A power supply connector 80 is provided in one piece with the terminal holder 78, the connector 80 accommodating a side of the bus-bar-like plate-like terminal.

Blade-like fuses (not shown) is attached to the upper and lower accommodating chambers 77*a* in parallel with each other in a horizontal direction. In correspondence to the upper and lower terminals, clamping terminals of the upper and lower plate-like terminals 76 are attached to an inside of the upper and lower accommodating chambers 77*a*. Power supply from a battery or an alternator is input to the connector 80.

In the above patent literature PTL 1, there is also shown an example of the mounting structure for the plate-like terminals, in which the terminal holder 78 is provided as a component separate from the fuse holder and the plate-like terminals 76 of each tier are attached in a vertically extending groove from above and horizontally. The circuit board 73 has at its intermediate portion in its thickness direction a copper core tier (not shown).

Another exemplary conventional mounting structure of the plate-like terminals (not shown) in the patent literature PTL 2 has a configuration in which a positioning groove is notched in a wide plate-like terminal (bus bar) having tab terminal portions in parallel with each other in multiple rows for connection of fusible link portion, and a projection is provided in a surface of a bottom wall of a box-shaped block body vertically accommodating the plate-like terminals.

CITATION LIST

Patent Literature

PTL 1: Japanese Patent Application Laid-Open Publication No. 2006-333583 (FIG. 6, FIGS. 1 and 2)

PTL 2: Japanese Patent Application Laid-Open Publication No. 2001-8332 (FIG. 2)

SUMMARY OF THE INVENTION

Technical Problem

In the case of the conventional mounting structure of the plate-like terminal disclosed in the patent literature PTL 1, it is not easy to provide accurate positioning of the plate-like terminals 76 in the multiple tiers to the terminal holder. If the plate-like terminal 76 is deviated from its intended position, connection of the terminal to the fuse may not be smoothly achieved.

Also, as the fuse is connected to and detached from (inserted into and taken out of) the plate-like terminals, a force acting in the event of insertion and detachment may be transferred to a soldered connection between the plate-like terminal and the circuit board, and as a result the soldered connection may have to endure undesirable complication.

These drawbacks may be found even when the plate-like terminals 76 are arranged not in multiple tiers but only in a single tier. Also, these drawbacks may also be observed in a case where connection is made to electrical components such as a fusible link and a relay other than the fuse or in a case where the plate-like terminals are used in a connector instead of the fuse block.

In view of the above-identified problem, an object of the present invention is to provide a plate-like terminal mounting structure that is capable of readily and accurately positioning the plate-like terminals in the terminal holder and providing connection with the electrical components such as the fuse smoothly and effectively without deviation of the terminals from their intended positioning, and preventing undesirable impacts of the plate-like terminal upon the circuit board in the course of connecting and detaching of the electrical components such as the fuse.

Solution to Problem

In order to attain the above objective, the plate-like terminal mounting structure of the plate-like terminal of a first aspect of the present invention is constructed to connect a plurality of plate-like terminals in parallel with each other to a terminal holder, and the terminal holder includes a plurality of tapering ribs arranged in parallel with each other, and the plate-like terminals each include a recessed portion or a hole configured to be brought into engagement with corresponding each of the ribs without a gap left therebetween in a regular mounting position of the plate-like terminals.

In the above-described configuration, in a state where the plate-like terminal intersects the rib, the recessed portion or the hole of the plate-like terminal is brought into engagement with the tapering rib without the gap therebetween (an internal edge or end face of the recessed portion or the hole abuts on the outer sloping surface of the tapered the rib) at a predetermined attachment position of the plate-like terminal in the height direction, and further movement of the plate-like terminals with respect to the ribs in the height direction (movement toward larger-diameter direction of the rib) is prevented, so that the plate-like terminals are provisionally secured by the terminal holder to be positioned with accuracy.

Also, the rectangular recessed portion or the hole of the plate-like terminals are brought into engagement with the cross-sectionally rectangular rib without any gap left therebetween, so that the oscillation of the plate-like terminal in a front-to-rear and right-to-left directions is prevented, and an insertion/detachment force when connecting/detaching the electrical component such as fuse to/from the plate-like terminal is accommodated by the rib, excessive stress load upon the connecting portion (soldered connection with the circuit board) of the plate-like terminal as opposed to the fuse is prevented. The recessed portion is provided at the both sides of the plate-like terminal, and the hole is provided at an intermediate portion of the plate-like terminal in the thickness direction.

The mounting structure of the plate-like terminal according to a second aspect of the resent invention is the mounting structure of the plate-like terminal according to the first aspect, wherein the ribs each include sloping surfaces at front, rear, left, and right sides of the ribs.

According to the above-described configuration, inner end surfaces on three sides of the recessed portion of the plate-like terminal and inner end surfaces on four sides of the rectangular hole of the plate-like terminal are brought into abutment and engagement with the front, rear, right, and left sloping surfaces of the rib without any gap left therebetween. Accordingly, oscillation and positional deviation of the plate-like terminals in front-to-rear and right-to-left directions are effectively prevented. Also, displacement of the plate-like terminals while insertion/detachment of the electrical component such as the fuse is effectively prevented.

The mounting structure of the plate-like terminal according to a third aspect of the present invention is the mounting structure of the plate-like terminal of the first or second aspect, wherein the terminal holder includes a partition wall separating the plate-like terminals from each other, the partition wall being in one piece with the ribs.

With the above-described configuration, the rib is coupled to the partition wall with improved stiffness of the rib, preventing flexure of the rib. It is possible for the rib to accommodate the insertion/detachment force in insertion and detachment of the electrical component such as the fuse more effectively. Also, prying force in insertion/detachment of the electrical component also help prevent positional deviation of the plate-like terminals.

The mounting structure of the plate-like terminal of a fourth aspect of the present invention is the plate-like terminal mounting structure according to any one of the first to third aspects, wherein the plate-like terminals are arranged in multiple tiers heightwise of the ribs, and the recessed portion or the hole of each of the plate-like terminals belonging to a lower-tier has a dimension corresponding to tapering of the rib, and the recessed portion or the hole of each of the plate-like terminals belonging to an upper-tier is smaller in proportion to the tapering of the rib than those of the plate-like terminals belonging to the lower tier.

According to the above-described configuration, the plate-like terminals are arranged in multiple tiers in a longitudinal direction (height direction) of the tapering ribs, and the recessed portion or the hole of the multiple-tiered plate-like terminals are each brought into engagement with the ribs without occurrence of oscillation, so that the multi-tiered plate-like terminals are provisionally secured to the terminal holder to be positioned accurately. Also, small recessed portion or the hole of the upper-tier plate-like terminals cannot be brought into engagement with the rib in the mounting position of the plate-like terminal of the lower-tier, so that the erroneous mounting of the upper-tiered the plate-like terminals to the terminal holder is prevented.

The mounting structure of the plate-like terminal according to a fifth aspect of the present invention is the plate-like terminal mounting structure according to the fourth aspect, wherein the holes of each of the plate-like terminals belonging to an uppermost-tier are each brought into engagement with corresponding each of extended tips of the ribs.

According to the above-described configuration, the plate-like terminals wider than the lower-tiered terminals are arranged in the uppermost-tier. Some of the ribs engaged with the recessed portion of the lower-tiered plate-like terminals are extended. The extended tips are brought into engagement with the holes of the plate-like terminals belonging to the uppermost-tier so that the plate-like terminals belonging to an uppermost-tier are positioned. The uppermost-tiered plate-like terminals are partitioned by an end of some of the extended partition walls among the partition walls.

The mounting structure of the plate-like terminal according to a sixth aspect of the present invention is the plate-like terminal mounting structure according to any one of the first to fifth aspects, wherein each of the plate-like terminals is bent substantially in an L-shape, one plate portion of each of the plate-like terminals being supported by the rib, an other plate portion thereof being inserted into the hole of the terminal holder, and a near-bending portion of the one plate portion being supported by an end wall of the hole.

According to the above-described configuration, the other plate portion of the substantially L-shaped plate-like terminal is inserted into the hole of the terminal holder and the one plate portion thereof is supported and positioned by the rib. The near-bending portion of the one plate portion abuts on the end wall of the hole of the terminal holder and is supported thereby, stably supported at two points, i.e., by the end wall of the hole and the tapered rib. The other plate portion is connected to the circuit board, and the electrical component such as the fuse is connected to the one plate portion.

Advantageous Effects of the Invention

According to the invention of the first aspect, when the plate-like terminals are attached to the terminal holder, since the recessed portion or the hole of the plate-like terminal is brought into engagement with the tapering rib of the terminal holder, it is possible to position the plate-like terminals readily and accurately. It is also possible to provide connection between the plate-like terminals and the electrical component such as the fuse smoothly and effectively without positional deviation of the terminals.

Also, tapered the rib of the terminal holder is brought into engagement with the recessed portion or the hole of the plate-like terminal without occurrence of the oscillation terminals therein, so that the insertion/detachment force of the electrical component such as the fuse is accommodated by the ribs and transfer of the force to the connecting portion between the plate-like terminals and the circuit board is prevented, so that the reliability of the electrical connection to the circuit board is increased.

According to the invention of the second aspect, positional deviation and oscillation of the plate-like terminal in four directions can be effectively prevented, and the insertion/detachment force of the electrical component such as the fuse is effectively accommodated by the ribs, so that the transfer of the force to the connecting portion connecting the plate-like terminals to the circuit board and other components incorporated thereon is effectively prevented.

According to the invention of the third aspect, the insertion/detachment force of the electrical component such as the fuse is effectively accommodated by the ribs in one piece with the partition wall without flexure of the ribs, and thereby undesirable impacts upon the connecting portion connecting the plate-like terminals to the circuit board and the other components incorporated thereon is further effectively prevented.

According to the invention of the fourth aspect, since the multiple tiered plate-like terminals are attached to the terminal holder to be brought into engagement with the tapering ribs, positioning of the plate-like terminals can be readily and accurately achieved. Also, by bringing the multiple-tiered plate-like terminals into engagement with the ribs, the insertion/detachment force for the electrical component such as the fuse is accommodated by the rib, and thereby the reliability of connection between the multiple-tiered plate-like terminals and the circuit board and other components incorporated thereon can be increased. Also, it is possible to prevent erroneous mounting of the plate-like terminals that should be attached to lower tier to the upper tier in the terminal holder.

According to the invention of the fifth aspect, in response to providing the plate-like terminals wider than that belong to the lower tier is used in the uppermost tier, the plate-like terminals belonging to the uppermost-tier is accurately positioned, and it is possible to increase the reliability of the connecting portion connecting the plate-k¥like terminals to the circuit board and other components incorporated thereon with respect to the insertion/detachment force of the electrical component such as the fuse.

According to the invention of the sixth aspect, the plate-like terminal is stably positioned and supported by two points, i.e., the end wall of the hole and the tapered rib of the terminal holder, and thus the connection and detachment of the electrical components such as the fuse is performed more smoothly and effectively.

REFERENCE NUMERALS

1 Terminal holder
4 to 6 Plate-like terminal
4*d*-6*d* Horizontal portion (the one plate portion)
4*e*-6*e* Vertical portion (the other plate portion)
4*d*'-6*d*' Near-bending portion
14 Rib
15 Partition wall
16-18 Recessed portion
22-24 Gap
25-27 Hole (hole of the terminal holder)
29, 30 End wall
31 Hole

DESCRIPTION OF EMBODIMENT

FIGS. 1 to 7 illustrate a mounting structure of plate-like terminals according to one embodiment of the present invention.

Figure 1:
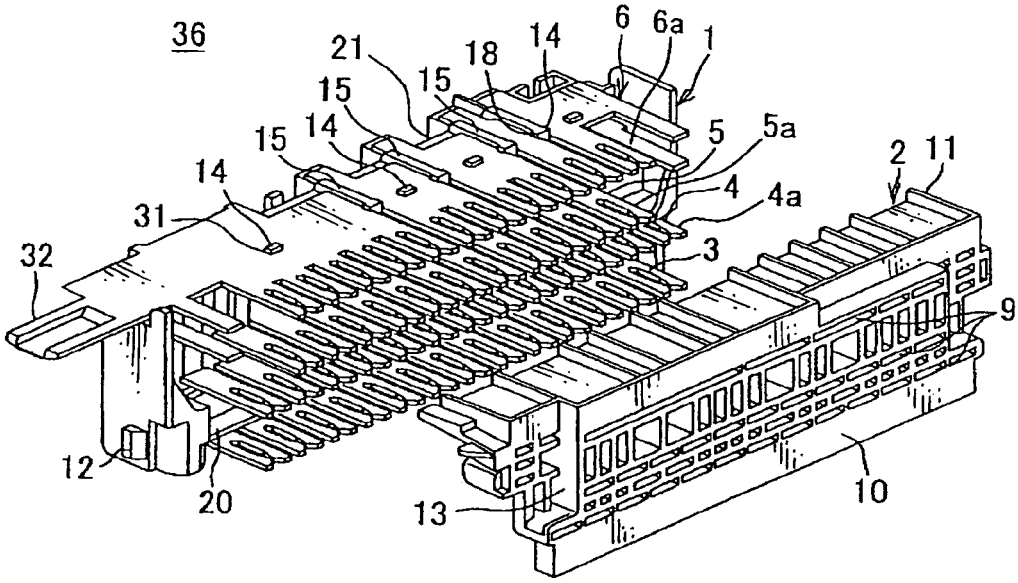
FIG. 1 is an exploded perspective view of a mounting structure pf a plate-like terminal according to one embodiment of the present invention.

Referring to FIG. 1, the reference sign 1 indicates a terminal holder (block body) made of insulating resin. The reference sign 2 indicates a terminal holder cover (block body) made of insulating resin. The reference signs 3 to 6 indicate a plurality of plate-like terminals adapted to be disposed in the terminal holder 1 in multiple tiers (four tiers in this embodiment). The terminal holder 1 is configured to be secured to a circuit board 7 (FIG. 8). The circuit board 7, which will be described later. is a component that belongs to a junction block 8 (FIG. 10), which also will be described later.

The terminal holder cover 2 is coupled to the terminal holder 1 horizontally from a front to a rear with the plate-like terminals 3 to 6 of the multiple tiers attached to the terminal holder 1. The plate-like terminal 4 to 6 belonging to the second to fourth tiers of the terminal holder 1 are inserted into and supported in a top-to-bottom manner in the terminal's thickness direction. The plate-like terminal of the first tier, meanwhile, is inserted and attached in a bottom-to-top manner. The mounting structure of the plate-like terminals of the present invention is mainly intended for mounting of the plate-like terminals 4 to 6 belonging to the second to fourth tiers, wherein the first tier is a lowermost tier and the fourth tier an uppermost tier. The fuse holder 33 (see FIG. 10) is adapted to be brought into locking with a locking projection 12 of the terminal holder 1.

The terminal holder cover 2 includes (i) a vertically extending front wall 10 having a horizontal-slit-like hole 9 into which clamping terminal portions 4*a* to 6*a* of the plate-like terminals 4 to 6 of the second to fourth tiers are inserted, (ii) a horizontally extending upper wall 11 covering the plate-like terminals 6 belonging to the fourth tier, and (iii) a vertically extending side walls 13 at right angles to the front wall 10 and the upper wall 11.

Figure 2:
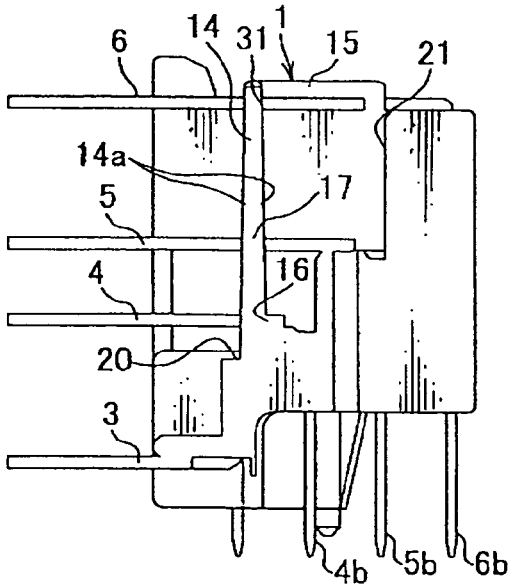
FIG. 2 is a vertical cross-sectional view of the mounting structure of the plate-like terminal in a state in which the same is being assembled.
Figure 3:
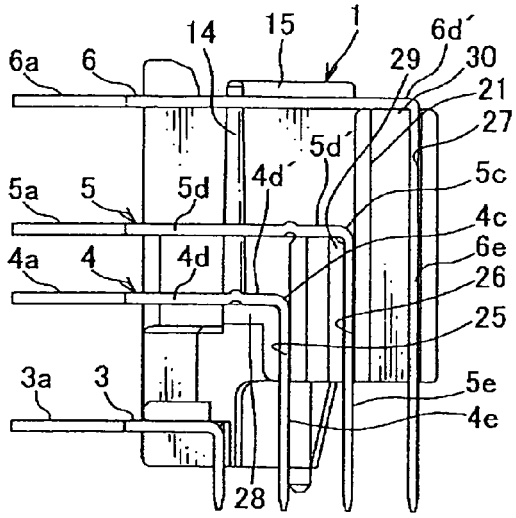
FIG. 3 is a vertical cross-sectional view of the mounting structure of the plate-like terminal, in which the cross section is taken at a portion different from that in FIG. 2.

Referring to FIGS. 2 and 3 illustrating cross-sectional views, the terminal holder 1 includes a plurality of vertically tapered ribs 14 in multiple rows in a terminal alignment direction for positioning the plate-like terminals 4 to 6 of the second to fourth tiers.

Figure 4:
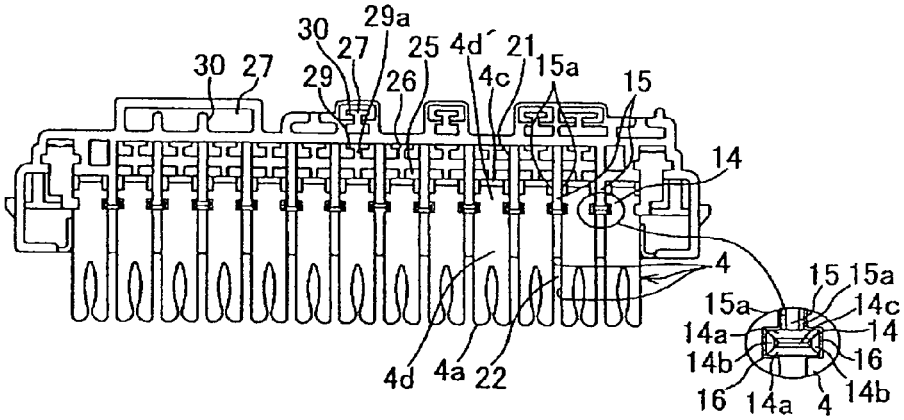
FIG. 4 is a plan view of the mounting structure of the plate-like terminal in the second tier.
Figure 5:
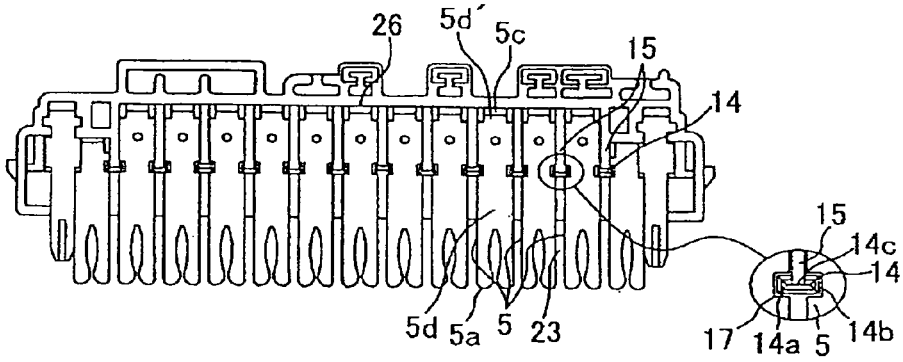
FIG. 5 is a plan view of the mounting structure of the plate-like terminal in the third tier.
Figure 6:
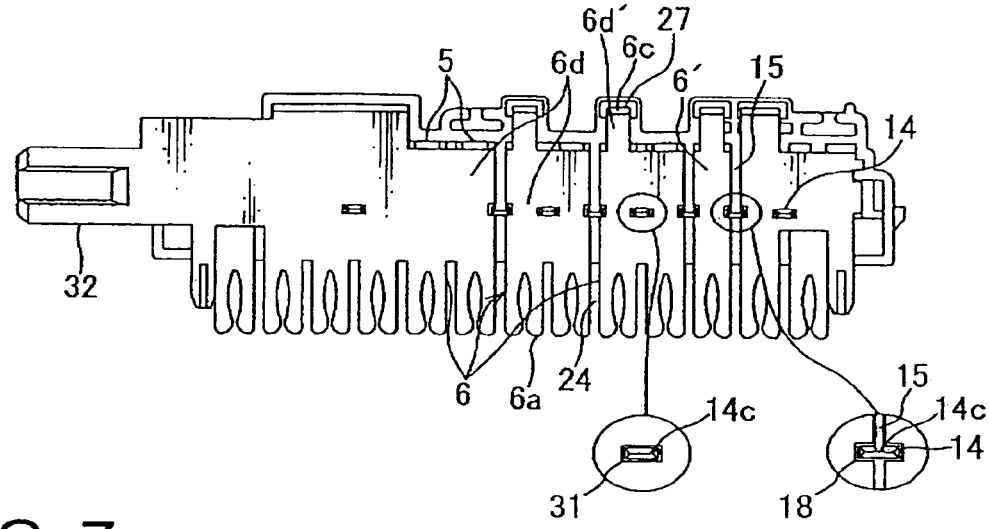
FIG. 6 is a plan view of the mounting structure of the plate-like terminal in the fourth tier.

As shown in FIGS. 4 to 6, the cross-sectionally rectangular ribs 14 are made in one piece at a front end of a vertically extending partition wall 15 of the terminal holder 1. The thickness of the rib 14 in its right-to-left direction is larger than that of the partition wall 15.

As shown in FIG. 2, the ribs 14 are each tapered in a front-to-rear direction. The ribs 14 each include sloping surfaces 14*a* on their front and rear sides. The thickness of the ribs 14 gradually and linearly decreases toward their tip (an upper end). Also, as shown in FIGS. 4 to 6, the ribs 14 are each tapered also in the right-to-left direction. The ribs 14 each include sloping surfaces 14*b* on their right and left sides, with the width gradually and linearly decreasing toward their tip (upper end). To sum up, the ribs 14 each have the front, rear, right, and left sloping surfaces 14*a*, 14*b* such that they tapers toward their tips. In FIG. 4, the reference sign 14*c* indicates a projection-like top surface (top face).

As shown in FIGS. 4 and 5 illustrating the plan views, the plate-like terminals 4, 5 belonging to the second and third tiers each have rectangular recessed grooves (recessed portion) 16, 17 on both sides in the width direction. Widths in the front-to-rear direction and in the right-to-left direction of the recessed groove 17 of the plate-like terminal 5 (see FIG. 5) belonging to the third tier are smaller than those of the recessed groove 16 of the plate-like terminal 4 (see FIG. 4) belonging to the second tier in the front-to-rear direction and in the right-to-left direction.

The recessed grooves 16, 17 of the plate-like terminals 4, 5 of these tiers are each brought into engagement with the tapered rib 14 without any gap therebetween (and accordingly without any oscillation therein) in a normal position of the plate-like terminals 4, 5 of these tiers in a height direction (it should be noted that the enlarged view includes a gap only for the sake of explanation). This construction prevents further downward movement of the plate-like terminals 4, 5 of these tiers so as to define the positioning of the plate-like terminals 4, 5 in the height direction.

Thus, the plate-like terminals 4, 5 can be inserted smoothly into the hole 9 of the terminal holder cover 2 (see FIG. 1) without positional deviation, and a terminal of the later-described fuse can be connected to the plate-like terminals 4, 5 smoothly and effectively without positional deviation. The plate-like terminals 6 belonging to the sixth-tier will be described later.

Also, the front and rear inner end faces of the recessed grooves 16, 17 of the plate-like terminals 4, 5 abut on the front and rear sloping surfaces 14*a* of the ribs 14, and thereby oscillation and positional deviation of the plate-like terminals 4, 5 in the front-to-rear direction (corresponding to the direction of insertion/detachment of the fuse) are prevented, and thus a fuse insertion/detachment force is prevented from being transferred to a soldered connection 19 (see FIG. 8) connecting the plate-like terminals 4, 5 to the circuit board 7 (see FIG. 8). Also, the right and left inner end faces of the recessed grooves 16, 17 of the plate-like terminals 4, 5 are brought into abutment on the sloping surfaces 14*b* of the rib 14, and thereby oscillation and positional deviation of the plate-like terminals 4, 5 in the right-to-left direction (corresponding to the terminal's width direction or alignment direction) are prevented.

The ribs 14 are made in one piece with the front end of the partition wall 15. The partition wall 15 continues at right angles to a bottom wall 20 and a rear wall 21 of the terminal holder 1. Accordingly, the rib 14 is protected against being bent, with improved stiffness of the ribs 14, and it is possible to accommodate the force acting in the front-to-rear and right-to-left directions of the plate-like terminals in the insertion/detachment of the fuse.

In the same manner as in the tapering of the ribs 14, the partition wall 15 may be tapered in the thickness direction with respect to the plate-like terminals 4, 5 belonging to the second and third tiers, with sloping surfaces 15*a* (see FIG. 4) defined on its right and left sides, and with its thickness gradually decreasing from a lower end of the partition wall 15 toward an upper end thereof.

In this case, a gap 23 (see FIG. 5) between a mutually adjacent pair of the plate-like terminals 5 of the third tier will be smaller than a gap 22 (see FIG. 4) between a mutually adjacent pair of the plate-like terminals 4 belonging to the second tier. In the normal position of the plate-like terminals 4, 5 with reference to the height direction, both side ends of the plate-like terminals 4, 5 are brought into abutment on the tapered partition wall 15 without a gap therebetween (and accordingly without oscillation therein). It should be noted that the enlarged view includes the gap only for the sake of explanation. By virtue of this, further downward movement of the plate-like terminals 4, 5 of these tiers is prevented. Also, in synergy with the tapered ribs 14, the positioning in the height direction of the terminals is defined, and positional deviation (oscillation) of the plate-like terminals 4, 5 in its width (right-to-left) direction is prevented.

The plate-like terminal 4, 5 belonging to the second and third tiers is bent substantially in an L-shape. With reference to the bent portions 4*c*, 5*c*, diapason-like clamping terminal portion 4*a* for fuse connection is provided in the front end side of the thin and elongated the horizontal portion (the one plate portion) 4*d*. A pin-like terminal 4*b*, 5*b* (FIG. 2) for connection of the circuit board is provided in the lower end side of the thin elongated vertical portion (the other plate portion) 4*e*, 5*e* (FIG. 3). The recessed grooves 16, 17 are provided on both sides of the horizontal portion 4*d*, 5*d*.

The vertical portions 4*e*, 5*e* have a width smaller than that of the horizontal portions 4*d*, 5*d*. Near-bending portions 4*d*', 5*d*' (see FIGS. 3 to 5) of the horizontal portions 4*d*, 5*d* each continue to the vertical portions 4*e*, 5*e*, respectively, and has a thin elongated shape. The vertical portions 4*e*, 5*e* are each inserted into and passed through holes 25, 26 (see FIGS. 3 and 4) of the terminal holder 1, respectively, from above in the vertical direction, with a lower surface of the near-bending portions 4*d*', 5*d*' of the horizontal portions 4*d*, 5*d* are brought into abutment upon the upper surface of the front end walls 28, 29 (FIGS. 3 and 4) of the holes 25, 26, respectively. The horizontal portions 4*d*, 5*d* are stably positioned and supported by two points, i.e., by the front end wall 28, 29 and by the rib 14 residing in a front region relative to the front end wall 28, 29. If the partition wall is tapered, the positioning is kept in a stable state by virtue of three points, i.e., by the front end wall 28, 29, the rib 14, and the both-side partition walls 15.

The rear end wall of the hole 26 for insertion of the plate-like terminal 6 of the third tier serves as part of the vertical rear wall 21 of the terminal holder 1, and the partition walls 15 protrude frontward from the rear wall 21. The front end wall 29 (see FIG. 4) of the hole 26 is divided into right and left regions by a central slit 29*a*. In FIG. 4, the hole 25 into which the plate-like terminal 4 of the second tier is inserted has a shape similar to that of the hole 26 into which the plate-like terminal 5 of the third tier is inserted.

As shown in FIG. 6, mainly, the plate-like terminal 6 belonging to the fourth tier is wide in the right-to-left direction and has a plurality of clamping terminal portions 6*a* in one piece therewith. The clamping terminal portions 6*a* are juxtaposed to each other. A rectangular (horizontally elongated) hole 31 is provided at a horizontal portion 6*d* (a one plate portion). In the example illustrated in FIG. 6, only one plate-like terminal 6' having the same thin elongated shape as the plate-like terminals 4, 5 of the lower-tiers is used. In the plate-like terminals 6', in the same manner as in the case of the plate-like terminals 4, 5 of the lower-tiers, a recessed groove 18 is positioned and supported by the rib 14.

An internal width of the hole 31 in the front-to-rear and right-to-left directions is smaller than the outer width of the rib 14 in the front-to-rear and right-to-left directions, the rib 14 corresponding to the plate-like terminals 4, 5 belonging to the second and third tiers. In the normal position of the plate-like terminal 6 belonging to the fourth tier, the normal position being defined in the height direction, an inner surface of the hole 31 abuts on the sloping surface 14*a*, 14*b* of the tip of the tapered rib 14 without any gap therebetween (or oscillation therein). It should be noted that the enlarged view includes a gap for the sake of explanation). The plate-like terminals 6 belonging to the fourth tier is prevented from moving any further downward, so that positioning in the height direction of the terminals is determined, positional deviation of the plate-like terminal 6 in the front-to-rear and right-to-left directions is prevented, and the force in insertion and detachment of the fuse is accommodated by the ribs 14, so that it is possible to prevent the fuse insertion/detachment force from being transferred to the soldered connection 19 connecting the terminals to the circuit board 7 (see FIG. 8).

The ribs 14 supporting the plate-like terminals 6 belonging to the fourth tier is the same as the ribs that positions the plate-like terminals 4, 5 belonging to the second and third tiers. The rib 14 corresponding to the hole 31 of the plate-like terminals 6 belonging to the fourth tier protrudes slightly longer (higher) than the other ribs (i.e., the rib 14 that does not support the plate-like terminal 6 belonging to the fourth tier).

If the partition wall 15 is tapered, the upper end portion of the partition wall 15 passed between the plate-like terminals 4, 5 of the second and third tiers is brought into engagement between each ones of the plate-like terminals 6 of the fourth tier without any gap therebetween, so that each of the plate-like terminals 6 belonging to the fourth tier is stably positioned and supported without oscillation in the right-to-left direction. The width of the upper end portion of the partition wall 15 is smaller than that of the intermediate portion of the partition wall corresponding to the plate-like terminals 5 belonging to the third tier. The gap 24 between the plate-like terminals 6 belonging to the fourth tier has a width smaller than that of the gap 23 between the plate-like terminals 5 belonging to the third tier.

The plate-like terminals 6 belonging to the fourth tier, in the same manner as in the case of the plate-like terminals 4, 5 belonging to the second to third tiers, are likewise bent substantially in an L-shape. A wide horizontal portion 6*d* and a narrow vertical portion 6*e* (see FIG. 3) are provided on both sides with respect to the bent portion 6*c*. A clamping terminal 6*a* is provided on the front side of the horizontal portion 6*e*. A pin-like terminal 6*b* (see FIG. 2) for the circuit board connection is provided on its lower end side of the vertical portion 6*e*.

Further, the vertical portion 6*e* is inserted into and passed through the hole 27 of the terminal holder 1, and the near-bending portion 6*d'* (see FIG. 3) of the horizontal portion 6*d* abuts against an upper surface of the front end wall 30 (end wall) of the hole 27 and is supported by the same. A frame-like hole 27 is arranged at a rear side of the rear wall 21 of the terminal holder 1. A tab terminal portion 32 for power supply protrudes on a lateral end of the plate-like terminal 6 belonging to the fourth tier. The tab terminal portion 32 is inserted into a connector housing 34 facing a lateral side of the fuse holder 33 (see FIG. 1) to serve as a connector for power supply. In the specification, the definition of the directions such as vertical, horizontal, front-to-rear, and right-to-left, is only for the sake of explanation, which does not necessarily corresponds to the mounting direction in which the junction block 8 (see FIG. 10) is mounted.

Figure 7:
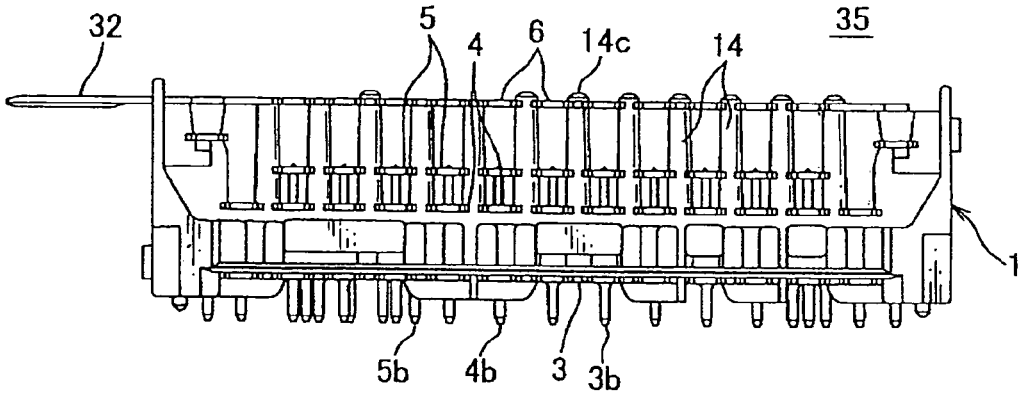
FIG. 7 is a front view of the mounting structure of the plate-like terminal of the each tier.

Referring to FIG. 7 illustrating the plan view of the assembly 35 incorporating the plate-like terminals 3 to 6 and the terminal holder 1, the horizontal portion 6*d* of the plate-like terminal 6 belonging to the fourth tier is arranged along the upper surface of the terminal holder 1. The upper end portion (also indicated by the reference sign 14*c*) of the tapered rib 14 of the terminal holder 1 slightly protrudes from the plate-like terminal 6 belonging to the fourth tier. The horizontal portions 4*d*, 5*d* (clamping terminal portion) of the plate-like terminals 4, 5 belonging to the second to third tiers are arranged on an intermediate portion of the terminal holder 1 in its height direction to be opposed to each other on its upper and lower side. A bus-bar-like wide horizontal portion 3*d* of the plate-like terminal 3 belonging to the first tier is arranged along the bottom surface of the terminal holder 1.

Each of the pin-like terminals 3*b* to 6*b* each continuing to the vertical portions 3*e* to 6*e* of the plate-like terminals 3 to 6 protrudes in a space downward of the terminal holder 1. The terminal block 36 and the power source block are constituted by the terminal holder 1, the plate-like terminals 3 to 6 of the multiple tiers, and the terminal holder cover 2 of FIG. 1.

Figure 8A:
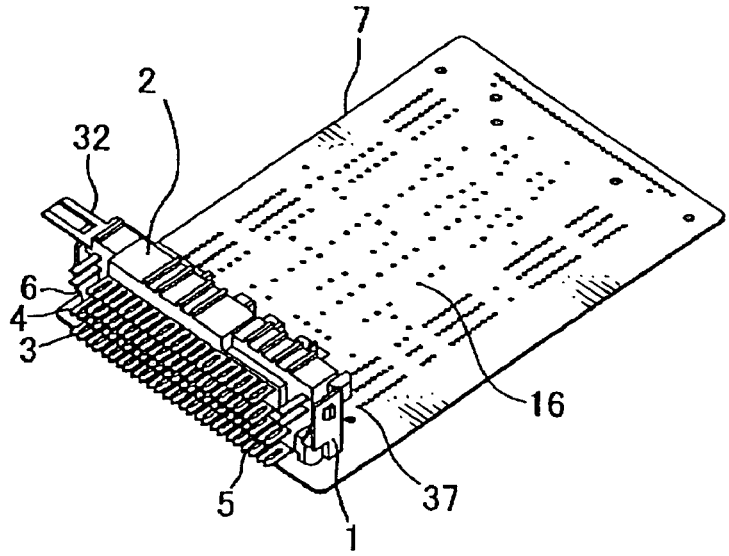
FIG. 8A is a perspective view of the terminal block in an assembled sate which is connected and secured to the circuit board.
Figure 8B:
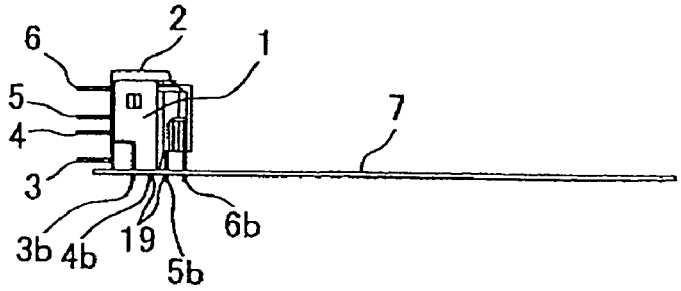
FIG. 8B is a side view of the terminal block in the assembled sate which is connected and secured to the circuit board.

As shown in FIGS. 8A and 8B, the vertical pin-like terminals 3*b* to 6*b* of the plate-like terminals 3, 6 are inserted into small holes 37 (throughhole) of the circuit board 7 and solder-connected thereto, so that a lowermost surface of the terminal holder 1 abuts on the upper surface of the circuit board 7 to be supported thereby. The pin-like terminals 3*b* to 6*b* of the plate-like terminals 3 to 6 belonging to first to four tiers are arranged from a front to a rear at intervals (see FIG. 2). The circuit board 7 includes at its intermediate portion in its thickness direction an electrically-conductive metal core tier (not shown).

Figure 9:
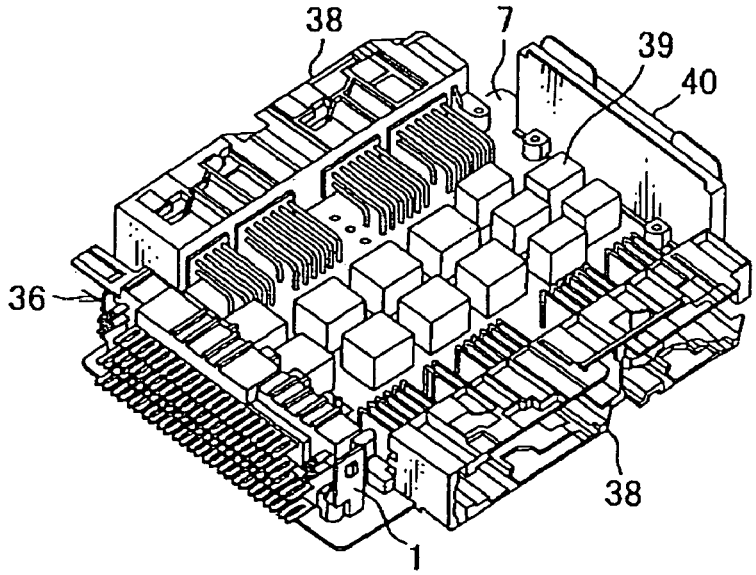
FIG. 9 is a perspective view of an exemplary circuit board assembly.

As shown in FIG. 9, the terminal block 36 is arranged upon a frontal area of the circuit board 7, the connector blocks 38 are arranged on a right area and a left area of the circuit board 7. A plurality of relays 39 are arranged on the circuit board 7 to reside between the connector blocks 38. A connector 40 dedicated to connection of the circuit board 7 to a control unit is arranged at a rear end of the circuit board 7. This is an example and the arrangement of the components 36, 38 to 40 can be defined as required.

Figure 10:
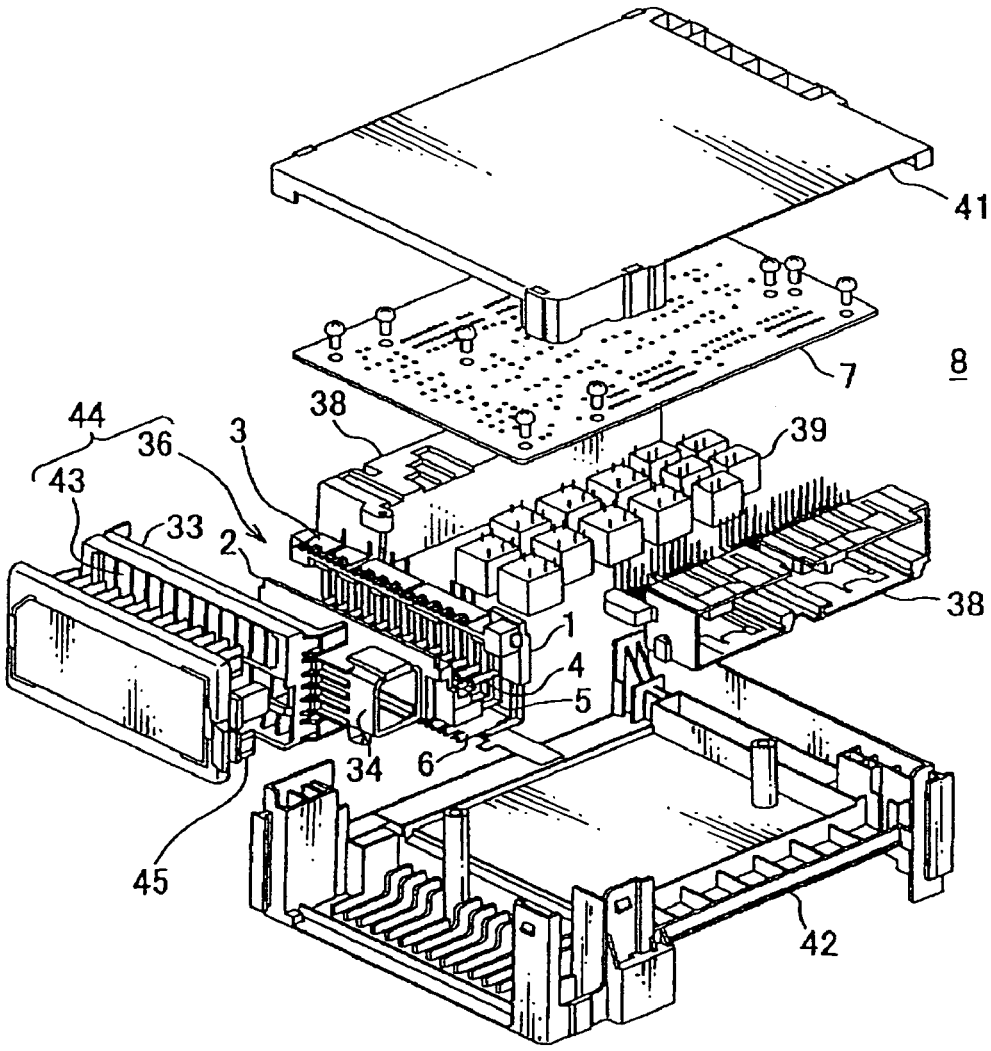
FIG. 10 is an exploded perspective view of an exemplary junction block.
Figure 11:
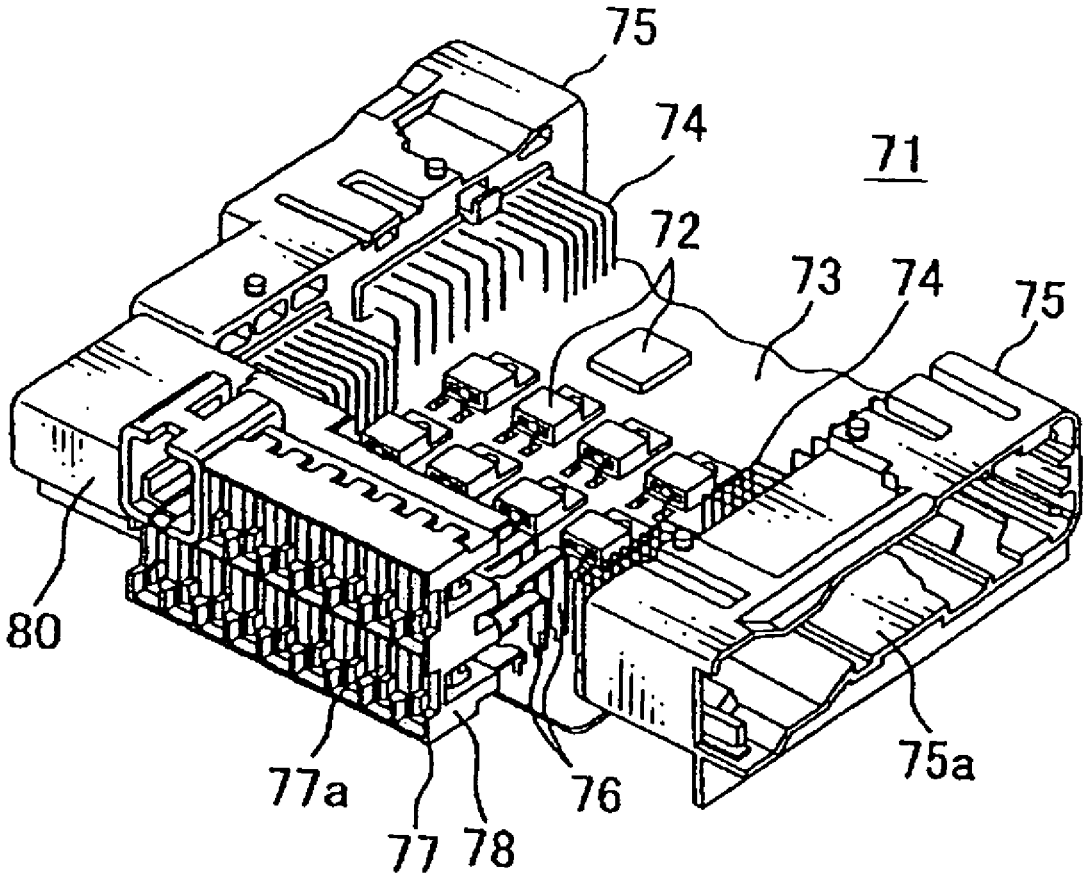
FIG. 11 is a perspective view of a principal part of a junction block that includes a conventional mounting structure of a plate-like terminal.

As shown in FIG. 10, in a state where the terminal block 36 and the circuit board 7 are top-to-bottom inverted, the outer cover 41 made of insulating resin is arranged in an upper space, and the inner cover 42 made of insulating resin is arranged in a lower space, the fuse holder 33 made of insulating resin is arranged at a front side of the terminal block 36, and the fuse holder 33 is coupled to the terminal block 36. The clamping terminal portions 3*a* to 6*a* of the plate-like terminals 3 to 6 are each accommodated in a fuse accommodating chamber 43 of the fuse holder 33. Blade-like fuses 45 are inserted into upper and lower tiers in the fuse accommodating chamber 43 and connected to the clamping terminal portions 3*a* to 6*a* to constitute the fuse block 44. The lower-tier fuses are connected to the plate-like terminals 3, 4 belonging to the first and second tiers. The upper-tier fuses are connected to the plate-like terminals 5, 6 belonging to the third and fourth tiers.

The fuse block 44 and the connector block 38 are covered by the upper and lower covers 41, 42 with the opening side exposed to an outside, so that the circuit board 7 and the relays 39 are accommodated in the covers 41, 42. The inner cover 42 is secured to a body of a vehicle by means of a not-shown bracket.

Although the above-described embodiment includes the plate-like terminals 3 to 6 arranged in a four-tiered fashion, the embodiment is not limited to such four-tiered configuration. The tapered rib 14 can also serve its purpose when the plate-like terminals are arranged according to more-than-four-tiered configuration and less-than-four-tiered configuration (including single-tiered configuration).

Also, in the above-described embodiment, the narrow plate-like terminals 4, 5 are arranged in the second to third tiers and the wide plate-like terminals 6 in the fourth tier. If the partition wall 15 is not used, for example, it is possible to provide the second tier or the third tier with the wide plate-like terminals, and the fourth tier with the narrow plate-like terminals.

Also, in the above-described embodiment, the plate-like terminals 3 to 6 connected to the circuit board 7 are mainly explained. In place of the circuit board 7, it is possible to apply the invention in the context of the plate-like terminals, which constitutes the connector, arranged in the terminal holder of a connector housing (not shown). In this case, tab terminal portions (not shown) in place of the clamping terminal portions 3*a* to 6*a* will be found at a tip of the plate-like terminals. The shape and dimension of the plate-like terminals 3 to 6 is not limited to the "substantially-L-shape-bent" type, and may extend linearly.

Also, the clamping terminal portions 3*a* to 6*a* are intended to be used for inserting and connecting the tab terminal of the fuse. A terminal portion having a different geometry may be provided for connection of a relay and a fusible link as the electrical components instead of the fuse.

Also, in the above-described embodiment, the holder cover 2 is attached to the terminal holder 1 of FIG. 1. The holder cover 2 may be eliminated and in place thereof the fuse holder 33 may be used. Also, in a state where the plate-like terminals 3 to 6 are connected to the circuit board 7, the plate-like terminals 3 to 6 may be connected to the fuse without using the holder cover 2.

INDUSTRIAL APPLICABILITY

The plate-like terminal mounting structure of the present invention is capable of accurate positioning of the plate-like terminals with respect to the holder and smooth and effective connection of the plate-like terminals to an electrical component such as a fuse without positional deviation of the terminals. The mounting structure allows single-tiered arrangement as well as multiple-tiered arrangement of the plate-like terminals. The plate-like terminals may be connected to electrical components other than the fuse, such as a fusible link and a relay. The plate-like terminals may be used in a connector in place of the fuse block.

The invention claimed is:

1. A plate-like terminal mounting structure constructed to connect a plurality of plate-like terminals in parallel with each other in a terminal holder, the improvement wherein the terminal holder includes a plurality of tapering ribs arranged in parallel with each other, and the plate-like terminals each include a recessed portion or a hole configured to be brought into engagement with corresponding each of the ribs without a gap left therebetween in a regular mounting position of the plate-like terminals, wherein the terminal holder includes at least a partition wall separating the plate-like terminals from each other, the partition wall being in one piece with the ribs and being perpendicular to the plate-like terminals; and each of the plate-like terminals is bent substantially in an L-shape, one plate portion of each of the plate-like terminals being supported by the rib, an other plate portion thereof being inserted into the hole of the terminal holder, and a near-bending portion of the one plate portion being supported by an end wall of the hole.

2. The plate-like terminal mounting structure and the improvement therein according to claim 1, wherein the ribs each include sloping surfaces at front, rear, left, and right sides thereof.

3. The plate-like terminal mounting structure and the improvement therein according to claim 1, wherein the plate-like terminals are arranged in multiple tiers heightwise of the ribs, and the recessed portion or the hole of each of the plate-like terminals belonging to a lower-tier has a dimension corresponding to tapering of the rib, and the recessed portion or the hole of each of the plate-like terminals belonging to an upper-tier is smaller in proportion to the tapering of the rib than those of the plate-like terminals belonging to the lower tier.

4. The plate-like terminal mounting structure and the improvement therein according to claim 3, wherein the holes of each of the plate-like terminals belonging to an uppermost-tier are each brought into engagement with corresponding each of extended tips of the ribs.

* * * * *